United States Patent [19]

Gostomski, Jr.

[11] 3,996,841

[45] Dec. 14, 1976

[54] HYDRAULIC PUMP OR MOTOR

[75] Inventor: Victor G. Gostomski, Jr., Peru, Ill.

[73] Assignee: Sundstrand Corporation, Rockford, Ill.

[22] Filed: Feb. 23, 1971

[21] Appl. No.: 118,101

[52] U.S. Cl. ..... 91/499

[51] Int. Cl.[2] ..... F01B 13/04

[58] Field of Search ..... 91/486, 499, 506, 507; 417/269

[56] References Cited

UNITED STATES PATENTS

| | | | |
|---|---|---|---|
| 1,675,933 | 7/1928 | Johnson | 308/237 R |
| 2,381,056 | 8/1945 | Huber | 417/269 |
| 2,709,339 | 5/1955 | Edelmann et al. | 417/252 |
| 3,249,061 | 5/1955 | Ricketts | 91/486 |
| 3,394,688 | 7/1968 | Roosa | 123/139.13 |

*Primary Examiner*—William L. Freeh
*Attorney, Agent, or Firm*—Wegner, Stellman, McCord, Wiles & Wood

[57] ABSTRACT

A hydraulic energy translating pump or motor of the axial piston type having a cam assembly for reciprocating the pistons in a rotary cylinder block, the cam assembly consisting of a rough machined or cast supporting surface with a thin, deformable, thrust ring being mounted on the rough supporting surface and having a smooth bearing surface slidably engaging bearing slippers pivotally mounted on the ends of the pistons.

2 Claims, 2 Drawing Figures

Inventor:
Victor G. Gostomski, Jr.
By Hofgren, Wegner,
Allen, Stellman & McCord,
Attys

HYDRAULIC PUMP OR MOTOR

BACKGROUND OF THE INVENTION

Hydrostatic transmissions have recently found considerable commercial acceptance as both vehicular transmissions and industrial transmissions. One form of a hydrostatic transmission includes a centrally located valve plate having inlet and outlet ports therein with a rotatable pump cylinder block slidably engaging one side of the valve plate and a motor cylinder block engaging the other side of the valve plate. Cam assemblies are provided for reciprocating pistons in cylinders in each of the cylinder blocks thereby delivering fluid under pressure to the motor cylinder block. The motor block rotates under the influence of fluid pressure being delivered thereto with the pistons in the motor block sliding down the motor cam assembly. The motor cylinder block is drivingly connected to an output shaft for the purpose of driving a load.

One or both of the units may be of the variable displacement type to provide an infinitely variable transmission ratio between input shaft speed and output shaft speed.

One of the disadvantages in prior hydrostatic transmission constructions, is that the cam assemblies have been difficult to machine because of their configuration or location, which may be directly within the hydrostatic transmission housing. Moreover, it is not always desirable to construct the cam support of a material suitable for slidably engaging the bearings or slippers on the ends of the pistons. That is, it may be desirable to construct the basic supporting cam member of a material such as aluminum which does have the required hardness or strength to provide a direct bearing surface for the piston bearing slippers.

While there have in the past been provided various types of rings mounted on the basic supporting cam surface, these rings have been rigid and undeformable so that when mounted on a rigid cam member tend to rock or pivot about the high spots on the cam surface if there are significant surface irregularities. Therefore, these prior constructions have required the accurate machining of the surface upon which the thrust or bearing ring is mounted, thereby increasing the cost of the cam assembly.

It is a primary object of the present invention to reduce the problems noted above in prior art hydrostatic transmissions by providing a cam assembly which is less expensive to construct while at the same time providing the material qualities and surface finish required for excellent dynamic operation of the piston slippers.

SUMMARY OF THE PRESENT INVENTION

In accordance with the present invention an improved cam assembly is provided for a hydrostatic pump or motor unit. The cam assembly reciprocates axially disposed pistons through hydrostatically balanced slippers pivotally connected to the ends of the pistons.

The cam assemblies for the pump and the motor may have either a rough cast supporting surface or a rough machined supporting surface thereby eliminating the requirement for a high finish on the cam's supporting surfaces.

Loosely mounted on each of the rough cam supporting surfaces is a thin, wafer-like, spring steel thrust ring having a rear surface engaging the rough cam surface and its opposite surface defining a bearing surface slidably engaging the piston slippers.

The spring steel thrust ring is sufficiently thin and flexible so that it conforms to the irregularities in the basic rough cam surface. The opposite bearing surface of the thrust ring does have, however, a smooth surface finish to provide an excellent bearing surface for the piston slippers.

This construction permits the thrust washer to be produced by blanking directly from a roll or flat sheet stock, having the material qualities and surface finish required for proper dynamic operation of the piston slippers.

Moreover, the conforming of the thin thrust washer to the irregularities in the basic cam supporting surface reduces any stresses being imparted to the cam.

The present cam assembly, as a result of its improved construction, reduces manufacturing costs and at the same time reduces the overall length of the pump, motor, and the combined transmission utilizing both.

DETAILED DESCRIPTION OF THE PREFERRED EMBODIMENT

Figure 1:
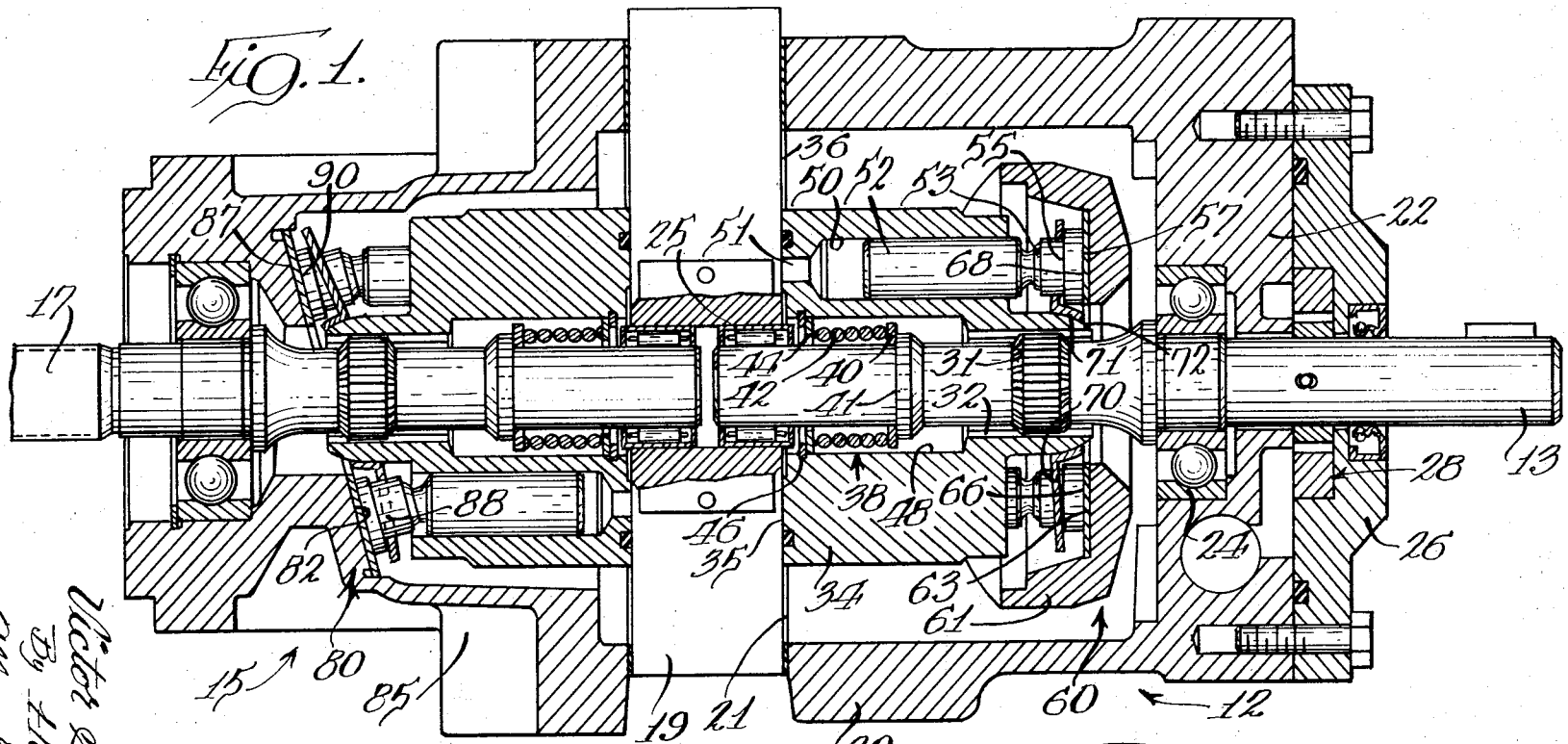
FIG. 1 is a longitudinal section of a hydrostatic transmission incorporating cam assemblies according to the present invention.

According to the drawings, a hydrostatic transmission 10 is illustrated consisting generally of a variable displacement axial piston pump 12 driven by input shaft 13 and a fixed displacement axial piston motor 15 drivingly connected to output shaft 17. Separating the pump and motor units is a valve plate 19 having arcuate inlet and outlet ports (not shown) interconnecting the pump and the motor.

Referring to the pump 12 in more detail, it is seen to include a generally bell-shaped housing 20 having an open end 21 fixed by suitable fasteners (not shown) to valve plate 19 and a closed end 22 carrying a bearing 24 for supporting the right end of input shaft 13. The left end of input shaft 13 is supported in a bearing 25 located in valve plate 19.

Fixed to housing end 22 is a cover plate 26 which houses a charge pump assembly 28 driven by input shaft 13 for the purpose of providing charge fluid to the hydraulic circuit between the pump 12 and the motor 15 in the manner known in the art.

The input shaft 13 has a splined section 31 interengaging internal splines 32 on a rotary cylinder block 34 having a sealing face 35 slidably engaging valve plate surface 36. For the purpose of holding the cylinder block surface 34 in sealing engagement with the valve plate surface 36, a cylinder hold-down spring assembly 38 is provided.

The hold-down spring assembly 38 includes a spring seat 40 urged against the shoulder 41 of shaft 13 by a coiled compression spring 42. The other end of the spring 42 reacts against spring seat ring 44 which in turn engages a snap ring 46 seated within central bore 48 in the cylinder block 34.

The cylinder block 34 has a plurality of axially disposed parallel cylinders 50 disposed in an annular array therein communicating with cylinder ports 51 which are disposed at a radius to register with the arcuate ports in the valve plate 19.

Reciprocable in the cylinders 50 are rigid pistons 52 having spherical ends 53 projecting from the cylinder block and received in suitable sockets in pivotally mounted piston slippers 55. Piston slippers 55 have bearing surfaces 57 which slidably engage a portion of the cam assembly 60 for the purpose of reciprocating the pistons 52 in the cylinder block and delivering fluid under pressure through the outlet port in valve plate 19 to the hydraulic motor 15 to drive the same and rotate the output shaft 17.

The cam assembly 60 includes a generally cup-shaped cam member 61 (often described as a swash-plate) which may be constructed, for example, of cast iron. The cam member 61 is pivotally mounted in the housing member 20 by suitable trunnions for the purpose of varying the displacement of the hydraulic pump 12 in a manner known in the art.

Cam member 61 has a cam supporting surface 63 that may be either rough machined or simply an unmachined cast surface. Surface 63 represents the cam reacting surface for the pistons 52, although the piston slippers 55 do not directly engage cam surface 63.

Figure 2:
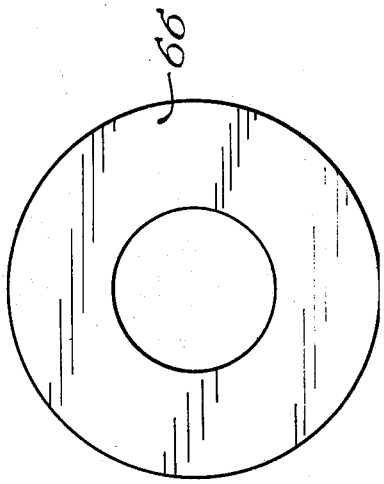
FIG. 2 is a plan view of a thrust ring according to the present invention.

Loosely mounted within cam member 61 against the cam surface 63 is a thrust ring 66 shown more clearly in FIG. 2.

The thrust ring 66 is constructed of thin, flexible, spring steel adapted to conform to the irregularities in the cam supporting surface 63 when engaged by slippers 55 under load, minimizing the stresses transferred to the cam member 61 as well as the requirement for accurate machining of cam member supporting surface 63.

The thrust ring 66 is preferably 0.050 inch in thickness or less and has a surface finish on bearing surface 68 of 16 RMS or less. This smooth surface finish assists in reducing the requirement for accurate machining, if any, of cam supporting surface 63. Because of the structural and material requirements for the thrust washer 66, it may be formed by a blanking operation directly from pre-finished roll or flat stock. An example of the material preferably used for this flat stock or roll is AMS 5122-C which is a spring steel of high hardness, having high strength, being cold worked with a high resistance to compression.

AMS 5122-C steel has the following composition:

| | Min. | Max. |
|---|---|---|
| Carbon | 0.89 | 1.04 |
| Manganese | 0.30 | 0.50 |
| Silicon | 0.15 | 0.30 |
| Phosphorus | — | 0.040 |
| Sulphur | — | 0.050 |

While the thrust ring or washer 66 is not adapted to rotate with the piston slippers 55, there may be some limited creep of the plate 66 with respect to the supporting surface 63 under load.

Bearing surface 68 of the thrust ring 66 is slidably engaged by the slipper bearing surfaces 57 as the cylinder block 34 rotates. For the purpose of holding the slippers 55 into engagement with the thrust ring surface 68, a piston hold-down ring 70 is provided, which is generally conical in configuration having a semispherical portion 71 engaging a semispherical projecting end 72 on the cylinder block. In this manner, the retaining ring 70 reacts against the cylinder block urging the slippers 55 into engagement with thrust ring surface 68. The retainer ring 70 is somewhat resilient.

The motor 15 is generally similar in construction to the pump 12, but it is of the fixed displacement type, rather than the variable displacement type. Motor 15 includes a cam assembly 80 having an unmachined or rough machine cam supporting surface 82 formed directly in motor housing 85. The minimal requirements for machining surface 82, is further exemplified in a fixed displacement unit where the cam is formed directly in the housing as in motor 15, since accurate machining thereof within the housing is difficult. Seated on cam surface 82 is a thrust washer 87 constructed in the same manner as thrust washer 66 for the pump. Motor piston slippers 88 slide against bearing surface 90 of the thrust washer 87 in the same manner as in the pump unit.

I claim:

1. A hydraulic energy translating device comprising: housing means, valve means in said housing means having inlet and discharge ports, a cylinder block rotatable relative to said valve means and having axial cylinders serially communicable with the inlet and discharge ports, pistons slidable in said cylinders, said pistons having bearing slippers pivotally mounted on the ends thereof, an inclinded cam plate at one end of the cylinder block for reciprocating said pistons in the cylinder block including a relatively rough supporting surface, and a thin flat thrust plate of resiliently flexible spring steel material loosely mounted on said supporting surface having a bearing slipper engaging surface on the side of the thin plate facing away from said rough supporting surface, said bearing slipper engaging surface being substantially smoother than said rough supporting surface, said thrust plate being sufficiently thin to resiliently deform against said rough supporting surface under normal hydraulic pressure of the device without undue stress in the thrust plate.

2. A hyrdraulic pump or motor unit, comprising: a housing, a valve member in said housing having an inlet port and an outlet port, a cylinder block having one end slidably engaging said valve member and having a plurality of axially disposed parallel cylinders that serially communicate with the inlet port and the outlet port as the cylinder block rotates, pistons slidable in said cylinders, bearing slippers pivotally mounted on the ends of the pistons and having bearing surfaces, an inclined cam plate at one end of the cylinder block for reciprocating said pistons in the cylinders including a relatively rough cast unmachined supporting surface having a finish substantially rougher than 16 RMS, and a flat deformable thrust ring of resilient spring steel material loosely positioned on said supporting surface and being sufficiently thin and resilient to resiliently conform to the irregularities in the supporting surface under normal load conditions without undue stress in the thrust ring and with return to an initial condition when not under load, said thrust ring having a bearing surface slidably engaging the slipper bearing surfaces and having a surface finish of 16 RMS or les.

* * * * *